United States Patent [19]

Pospisal et al.

[11] Patent Number: 4,663,788

[45] Date of Patent: May 12, 1987

[54] WAVE-DAMPENING APPARATUS FOR A WATERBED

[76] Inventors: Gary L. Pospisal, Rte. 1, Box 223B, Council Bluffs, Iowa 51501; John K. Beier, 901 S. 89th St., Omaha, Nebr. 68114

[21] Appl. No.: 853,439

[22] Filed: Apr. 18, 1986

[51] Int. Cl.[4] ..... A47C 27/08

[52] U.S. Cl. ..... 5/450; 5/451

[58] Field of Search ..... 5/451, 450, 452, 449, 5/422, 455, 481

[56] References Cited

U.S. PATENT DOCUMENTS 4,467,485 8/1984 Hall ..... 5/451

4,481,248 11/1984 Fraige ..... 5/451

4,517,691 5/1985 Phillips ..... 5/450

FOREIGN PATENT DOCUMENTS 1175165 9/1984 Canada ..... 5/451

*Primary Examiner*—Alexander Grosz

*Attorney, Agent, or Firm*—Zarley, McKee, Thomte, Voorhees & Sease

[57] ABSTRACT

A wave-dampening apparatus is disclosed for use in a waterbed mattress. The apparatus comprises a layer of fibrous material which is positioned within the mattress bladder and which has a plurality of elongated float members embedded therein in a spaced-apart relationship.

8 Claims, 4 Drawing Figures

WAVE-DAMPENING APPARATUS FOR A WATERBED

BACKGROUND OF THE INVENTION

This invention relates to a wave-dampening apparatus for a waterbed and more particularly to an apparatus which is extremely economical and therefore cost effective.

Many types of apparatuses have been provided for dampening the wave action within the bladder of a waterbed mattress. One method of dampening the wave action within the waterbed mattress is to substantially fill the bladder with a fibrous material. Although such an apparatus does dampen the wave action within the mattress, the fibrous material reduces the comfort of the bed as well as being fairly expensive.

Layers of fibrous material have also been inserted into the bladder of the waterbed mattress with the layers of fibrous material having a thickness less than the thickness of the bladder. Since the wave action occurs in the upper portion of the mattress, the layer of fibrous material must be somehow floated on the water if the desired wave-dampening action is to be achieved. One method of floating the layer of fibrous material is to sew or otherwise tie strips of foam material to the layer of fibrous material. The requirement of sewing or tying the float members to the layer of fibrous material is time-consuming and results in high labor costs. Additionally, the float members sometimes become detached from the layer of fibrous material and the effectiveness of the fibrous material is therefore severely reduced.

Another method of floating the fibrous material within the mattress is to embed STYROFOAM expanded, rigid, polystyrene plastic pellets or particles in the fibrous material. However, the pellets or particles do not remain in the fibrous material and sometimes clog or plug any pump or filtering devices associated with the mattress.

It is therefore a principal object of the invention to provide an improved wave-dampening apparatus for use with a waterbed mattress.

Yet another object of the invention is to provide a device of type described which is cost effective.

Still another object of the invention is to provide a wave-dampening apparatus for a waterbed mattress comprising a layer of fibrous material having a plurality of elongated float members embedded in the fibrous material in a spaced-apart relationship.

A further object of the invention is to provide a wave-dampening apparatus for use with a waterbed mattress which includes float members embedded in a layer of fibrous material in such a manner that the float members will not become disengaged therefrom.

Yet another object of the invention is to provide a wave-dampening apparatus for use with a waterbed mattress which may be easily installed in the mattress bladder.

These and other objects will be apparent to those skilled in the art.

SUMMARY OF THE INVENTION

Figure 1:
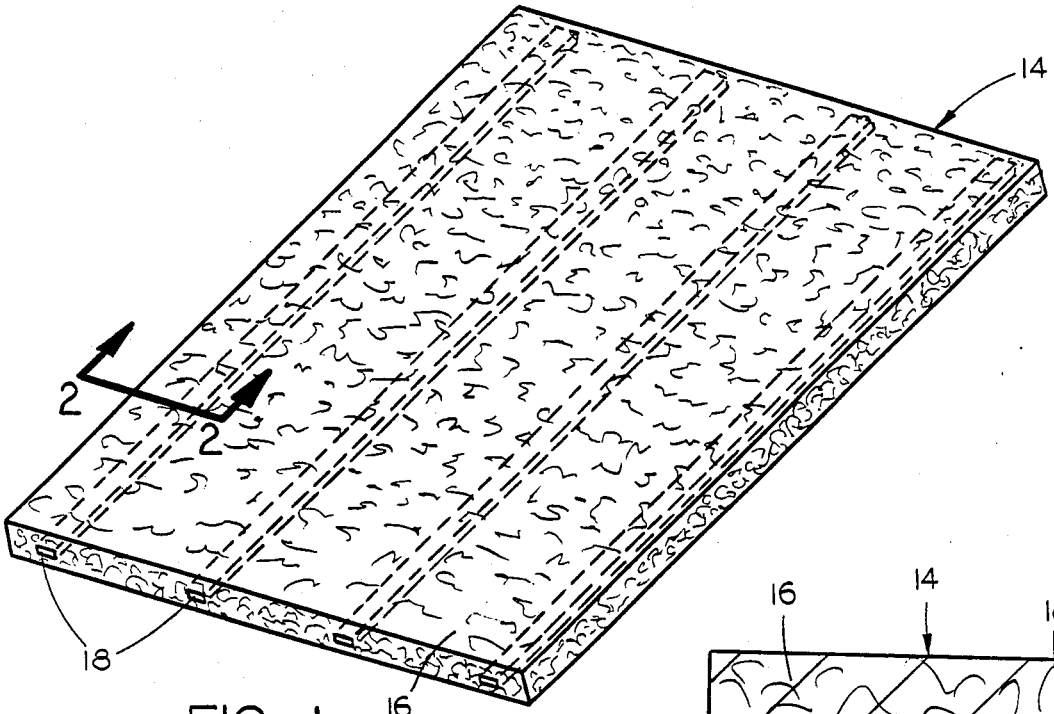
FIG. 1 is a perspective view of the apparatus of this invention.
Figure 2:
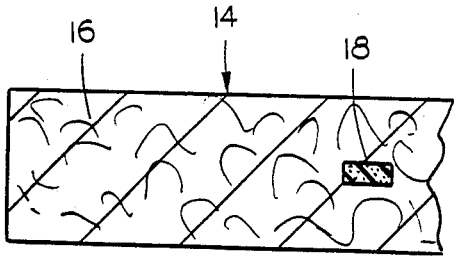
FIG. 2 is an enlarged sectional view as seen on lines 2—2 of FIG. 1.
Figure 3:
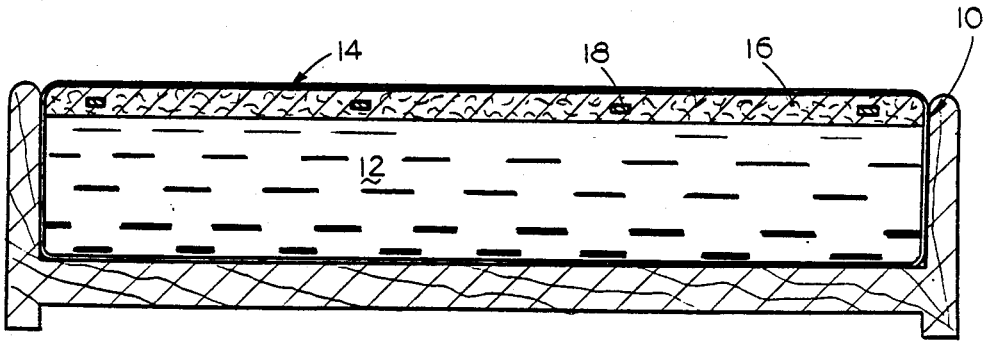
FIG. 3 is a transverse sectional view of a waterbed mattress having the apparatus of this invention mounted therein.
Figure 4:
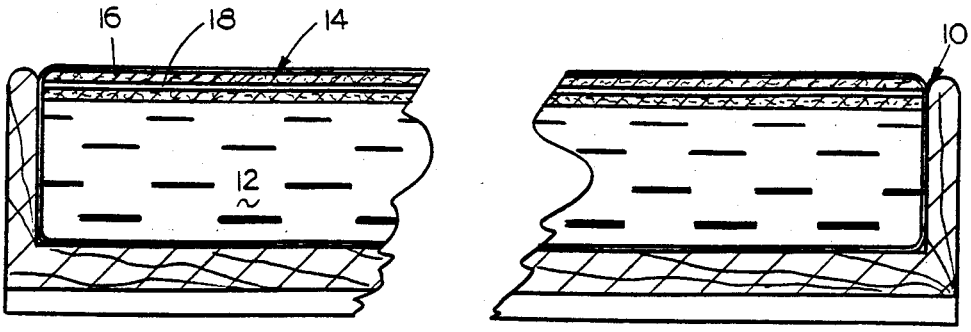
FIG. 4 is a longitudinal sectional view of the waterbed mattress having the apparatus of this invention mounted therein.

A wave-dampening apparatus is disclosed for use with a waterbed mattress bladder. The apparatus of the invention comprises a layer of fibrous material positioned within the mattress bladder and which extends substantially between the ends and sides thereof. The layer of fibrous material has a thickness less than the thickness of the bladder and has a plurality of elongated, substantially horizontally disposed and horizontally spaced-apart float members embedded therein. The float members cause the layer of fibrous material to float on the water within the mattress.

DESCRIPTION OF THE PREFERRED EMBODIMENT

The numeral 10 refers to a conventional waterbed mattress bladder having water 12 positioned therein. The wave-dampening apparatus of this invention is positioned within the bladder 10 and is referred to generally by the reference numeral 14. Wave-dampening apparatus 14 is comprised of a layer of fibrous material 16 preferably comprised of polyester fibers which are bound together with a suitable binder. The preferred binder is RHOPLEX TR-407 manufactured by Rhom & Haas Company which is an acrylic emulsion. Another satisfactory binder is SA-220 manufactured by Sun Chemical Company.

During the manufacture of the layer 16, a plurality of elongated, substantially horizontally disposed and horizontally spaced-apart float members 18 are embedded within the layer 16. Preferably, the float members 18 are rectangular in shape and are comprised of a closed cell material having a specific gravity less than 1.0 and preferably 0.25. The float members are preferably comprised of a flexible polyethylene foam.

The layer of fibrous material is inserted within the bladder 10 during the fabrication thereof. When the bladder 10 is filled with water, the float members 18 will cause the layer 16 to float on the water so that the layer is positioned on the water as illustrated in the drawings. The length and width of the layer 16 will obviously vary depending upon the size of the mattress. It is preferred that the layer 16 have a length and width approximately four inches shorter than the length and width of the bladder 10 so that the layer will be properly positioned at the upper horizontal portion of the mattress. The thickness of the layer 16 will also vary depending upon the desired end results. Similarly, the spacing of the float members 18 also will depend upon the type of flotation and effect desired.

Although it is preferred that the float members be disposed within the fibrous material as depicted in the drawings, the float members may also be arranged as cross members in a "grid" or "grid-iron" manner.

It can therefore be seen that a novel means has been provided for positioning a layer of fibrous material within a waterbed mattress in such a manner that is cost effective and in such a manner so that the float members associated therewith will not become detached from the layer of fibrous material. It can therefore be seen that the invention accomplishes at least all of its stated objectives.

We claim:

1. In combination with a waterbed mattress bladder having opposite ends and sides, a wave-dampening apparatus comprising, a single layer of fibrous material positioned within the bladder and extending substantially between the ends and sides thereof, said layer of fibrous material having a thickness less than the thickness of said bladder, and a plurality of elongated, spaced apart substantially horizontally disposed float members embedded within said layer of fibrous material said float members being substantially completely surrounded by said fibrous material and extending a substantial horizontal distance within said fibrous material for causing said layer of fibrous material to float on the water within the bladder.

2. The combination of claim 1 wherein said fibrous material comprises polyester fibers which are bonded together.

3. The combination of claim 1 wherein said float members are rectangular in shape.

4. The combination of claim 1 wherein said float members are comprised of a closed cell material.

5. The combination of claim 4 wherein said closed cell material has a specific gravity less than 1.0.

6. The combination of claim 4 wherein said closed cell material has a specific gravity of approximately 0.25.

7. The combination of claim 4 wherein said closed cell material is comprised of a polyvinyl material.

8. In combination with a waterbed mattress bladder having opposite ends and sides, a wave-dampening apparatus comprising, a single layer of fibrous material positioned within the bladder and extending substantially between the ends and sides thereof, and a plurality of elongated, spaced apart substantially horizontally disposed float members embedded within said layer of fibrous material said float members being substantially completely surrounded by said fibrous material and extending a substantial horizontal distance within said fibrous material for causing said layer of fibrous material to float on the water within the bladder.

* * * * *